United States Patent [19]

Adachi et al.

[11] Patent Number: 4,488,087

[45] Date of Patent: Dec. 11, 1984

[54] DISCHARGE LAMP LIGHTING DEVICE

[75] Inventors: Hiromi Adachi, Kamakura; Shoichi Iwaya, Kisagata, both of Japan

[73] Assignees: TDK Corporation; Mitsubishi Denki Kabushiki Kaisha, both of Tokyo, Japan

[21] Appl. No.: 492,017

[22] Filed: May 5, 1983

[30] Foreign Application Priority Data

May 6, 1982 [JP] Japan ..... 57-76091

[51] Int. Cl.[3] ..... H05B 39/00

[52] U.S. Cl. ..... 315/101; 315/207; 315/243; 315/DIG. 7

[58] Field of Search ..... 315/243, 101, DIG. 7, 315/207

[56] References Cited

U.S. PATENT DOCUMENTS 3,836,817 9/1974 Tchang et al. ..... 315/101
3,978,368 8/1976 Tomura et al. ..... 315/101
4,165,475 8/1979 Pegg et al. ..... 315/101
4,381,476 4/1983 Adachi et al. ..... 315/243
4,442,380 4/1984 Adachi ..... 315/101

*Primary Examiner*—Harold Dixon
*Attorney, Agent, or Firm*—Armstrong, Nikaido, Marmelstein & Kubovcik

[57] ABSTRACT

A discharge lamp lighting device comprises a discharge lamp (1) with a pair of filaments (101*a*, 101*b*), an inductive balast (2) coupled with said lamp (1) and a power supply, a non-linear dielectric element (4) coupled across said lamp (1), a semiconductor switch (3) coupled substantially parallel with said non-linear dielectric element (4), and delay means ((6,7,303*c*,304*b*,303*d*), (8,303*c*,304*b*,303*b*), (9,10,60), (6,11)) for shifting firing phase of said semiconductor switch (3) so that a spike voltage induced by said non-linear dielectric element increases gradually for every cycle of a power supply voltage.

6 Claims, 8 Drawing Figures

DISCHARGE LAMP LIGHTING DEVICE

BACKGROUND OF THE INVENTION

The present invention relates to a discharge lamp lighting device, or a starter of a fluorescent lamp with a semiconductor element.

FIG. 1 is a prior fluorescent lamp starter circuit which has a non-linear dielectric element and a semiconductor switch like a thyristor. In FIG. 1, the reference numeral 1 is a fluorescent lamp, 2 is an inductive balast, 3 is a semiconductor switch, 4 is a non-linear dielectric element, 5 is a capacitor for noise prevention purpose, and U and V are power supply terminals.

The fluorescent lamp 1 has filaments 101*a* and 101*b* at both the extreme ends of the same. The semiconductor switch 3 has a thyristor 301, a trigger element 302 (SBS(Silicon Bilateral Switch), or a diac), resistors 303*a* and 303*b*, and a capacitor 304.

When an alternate voltage $e_{uv}$ as shown by the dotted line in FIG. 2 is applied to the power input terminals U and V, the thyristor 301 turns ON at the phase $\theta_1$ in the positive half cycle, then, the thyristor 301 closes and the current flows from the terminal U, through the balast 2, filament 101*a*, thyristor 301, filament 101*b*, to the other terminal V. Thus, the filaments 101*a* and 101*b* are preheated. Next, at the phase $\theta_2$ in the negative half cycle, when the current in the thyristor 301 becomes zero, that thyristor 301 turns OFF. At that time, the voltage across the non-linear dielectric element 4 is zero, and the power supply voltage $e_{uv}$ is close to the peak voltage in the negative polarity, therefore, the non-linear dielectric element 4 is charged as shown in FIG. 2 through the balast 2.

The non-linear dielectric element 4 has the saturable characteristics between the applied field V and the charge Q as shown in FIG. 3, and has the non-linear nature, in particular when the applied field V exceeds the saturation voltage $E_s$. Therefore, if the saturation voltage $E_s$ is lower than the peak voltage of the power supply voltage, the current flowing into the non-linear dielectric element 4 decreases suddenly when the instantaneous voltage of the power supply exceeds the saturation voltage $E_s$. When the current decreases suddenly, the pulsive spike voltage $V_{21}$ which is extremely higher than the peak value of the power supply voltage is induced across the inductive balast, and that voltage $V_{21}$ is applied across the fluorescent lamp 1. The value of that spike voltage $V_{21}$ depends upon the differential current (di/dt) and the inductance L of the balast 2. After that spike pulse $V_{21}$ disappears, the power supply voltage $e_{uv}$ is applied to the fluorescent lamp until the thyristor 301 turn ON again.

The above operation continues until the fluorescent lamp 1 is fired. When the filaments 101*a* and 101*b* of the fluorescent lamp are pre-heated sufficiently, the fluorescent lamp 1 is fired by that spike voltage $V_{21}$, and/or the positive voltage $V_{11}$ by the spike voltage before the time $O_7$. When the fluorescent lamp 1 is fired, the voltage across the lamp decreases because of the presence of the balast 2, therefore, the thyristor 301 does not turn ON during the fired period of the fluorescent lamp 1.

It should be noted that the voltage across the fluorescent lamp 1 becomes higher than the power supply voltage, as shown by $V_{12}$ and $V_{22}$ in FIG. 2, due to the charging operation of the non-linear dielectric element 4. Those high components $V_{12}$ and $V_{22}$ are absorbed by the capacitor 304, and therefore, the thyristor 301 does not turn ON by that voltage $V_{22}$.

The circuit of FIG. 1 fires a fluorescent lamp with a non-contact switch and a non-linear dielectric element, and has the advantage of the quick start of a lamp. The firing time with the circuit of FIG. 1 is less than 0.8 second, which is extremely shorter than that of a prior glow-lamp type starter. It should be noted that it takes 2–8 seconds in a prior glow-lamp type starter. Further, the circuit of FIG. 1 has the advantage that the device is light in weight, and small in size as compared with a prior rapid-starter type circuit.

However, the circuit of FIG. 1 has the disadvantage as described below. Supposing that a power switch is switched on at the phase $\theta_0$ in FIG. 2, then, the filaments 101*a* and 101*b* are heated during $\theta_1$ and $\theta_2$, but the pre-heating in that period is not enough, and the temperature of the filaments is insufficient to fire the lamp. By the way, at the phase $\theta_4$, the high spike voltage $V_{21}$ is induced, and is applied to the filaments, which are not heated enough. It should be appreciated that the radiation material, like Barium-Oxide (BaO), attached on the surface of a filament for radiating hot electron is sputtered and deteriorated when high voltage is applied to that radiation material which is not hot enough. The amount of the sputtered material is significant since the spike voltage $V_{21}$ is applied for each cycle of the power supply voltage until the fluorescent lamp is fired. Thus, a prior circuit of FIG. 1 has the disadvantage that the life time of a lamp is rather short.

SUMMARY OF THE INVENTION

It is an object, therefore, of the present invention to overcome the disadvantages and limitations of a prior discharge lamp lighting device by providing a new and improved discharge lamp lighting device.

It is also an object of the present invention to provide a discharge lamp lighting device which provides long life time of a discharge lamp by preventing the sputtering of radiation material on filaments.

The above and other objects are attained by a discharge lamp lighting device comprising a discharge lamp with a pair of filaments coupled with a power supply through an inductive balast; a non-linear dielectric element coupled between said filaments; a semiconductor switch coupled parallel with said non-linear dielectric element for shunting said non-linear dielectric element at some phase of a power supply voltage; and a delay means for gradually delaying a firing phase of said semiconductor switch for every cycle.

BRIEF DESCRIPTION OF THE DRAWINGS

The foregoing and other objects, features, and attendant advantages of the present invention will be appreciated as the same become better understood by means of the following description and accompanying drawings wherein.

DESCRIPTION OF THE PREFERRED EMBODIMENTS

Figure 1:
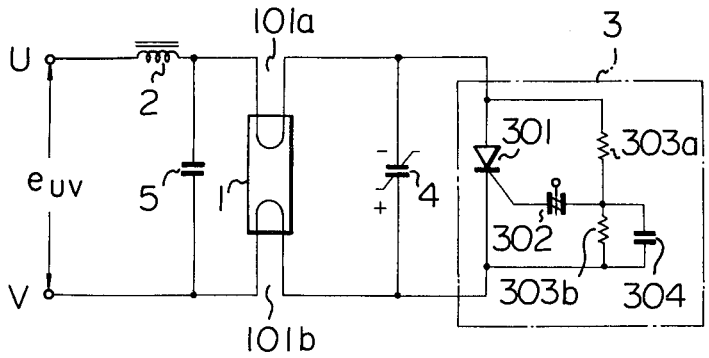
FIG. 1 is a circuit diagram of a prior discharge lamp lighting device.
Figure 4:
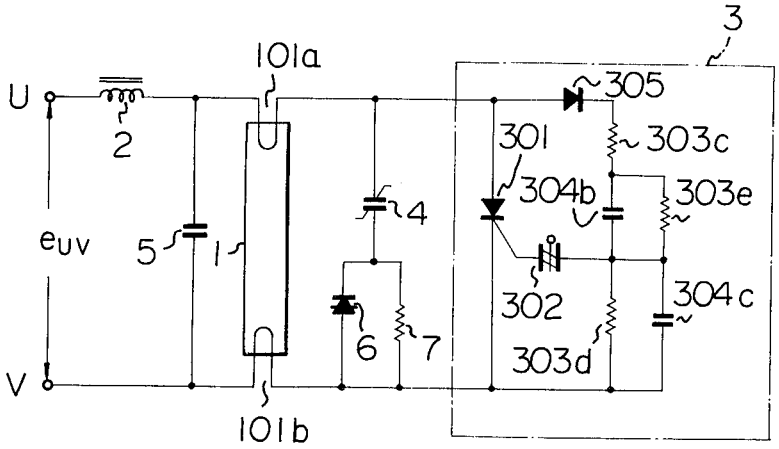
FIG. 4 is a circuit diagram of the discharge lamp lighting device according to the present invention.

FIG. 4 is a circuit diagram of the discharge lamp lighting device according to the present invention. In the figure, the same reference numerals as that of FIG. 1 show the same component as that of FIG. 1. The feature of the embodiment of FIG. 4 is that the semiconductor switch 3 has a timer circuit at the gate circuit of the thyristor for adjusting the firing timing of the thyristor 301. That timer circuit comprises the resistors 303*c* and 303*d*, the capacitor 304*b* and the diode 305. The reference numeral 303*e* is a resistor, and 304*c* is a capacitor. The reference numeral 6 is a two-terminals-thyristor, like a PNPN switch or SSS (Silicon Symmetrical Switch) coupled in series with the non-linear dielectric element 4 for providing a charging circuit for that element. The reference numeral 7 is a resistor coupled parallel with said thyristor 6 for providing a discharge path for the non-linear dielectric element 4.

Figure 5:
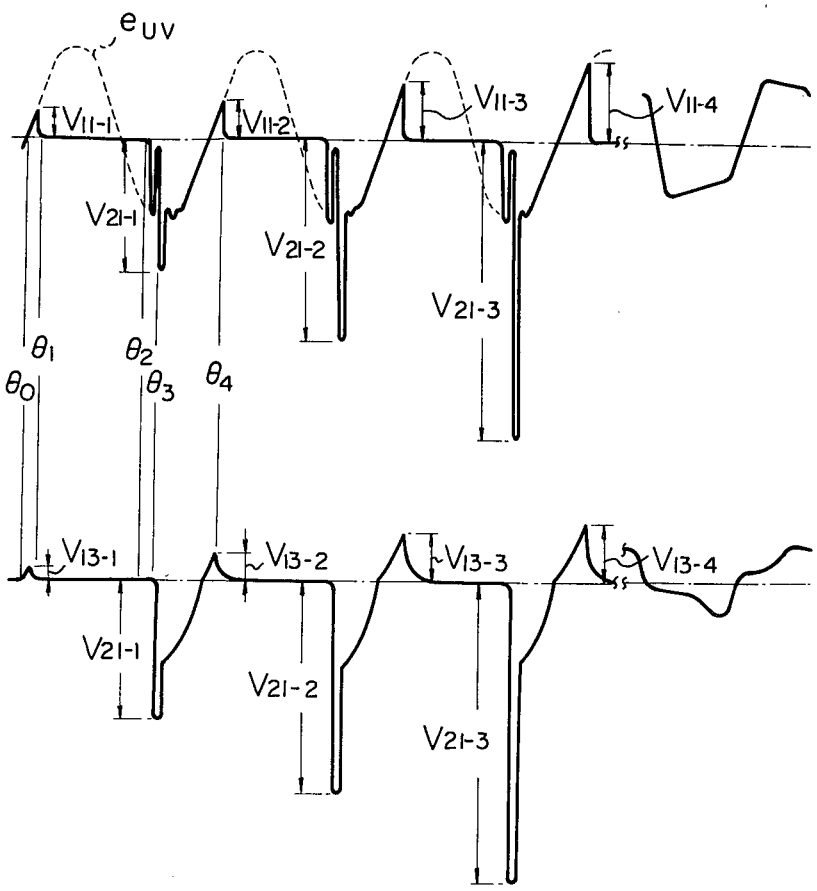
FIG. 5 shows operational waveforms of the device of FIG. 4.

Now, the operation of the circuit of FIG. 4 is described in accordance with waveforms in FIG. 5. In FIG. 5, the curve (a) shows voltage waveform across the fluorescent lamp 1, and the curve (b) shows the voltage waveform across the non-linear dielectric element 4.

Supposing that the power switch (not shown) is switched ON at the phase $\theta_0$, the current flows in the timer circuit which has a diode 305, a resistor 303*c*, a capacitor 304*b* and a resistor 303*d*. The power supply voltage is divided only by the resistors 303*c* and 303*d* at the first stage just after the power switch is turned ON since no charge is stored in the capacitor 304*b* at the first stage. The voltage across the resistor 303*d* turns ON the trigger element 302 at the phase $\theta_1$, then, the thyristor 301 turns ON. Then, the current flows between the phase $\theta_0$ and $\theta_1$ through the balast 2, the filament 101*a*, the thyristor 301, and the filament 101*b* to pre-heat the filaments. At the phase $\theta_2$ when the preheat current becomes zero in the negative half cycle of the power voltage, the thyristor 301 turns OFF, and the negative power supply voltage is applied to the fluorescent lamp 1. That voltage across the fluorescent lamp 1 is divided by the resistor 7 and the non-linear dielectric element 4. The resistance of the resistor 7 is so designed that the voltage across the resistor 7 is higher than the threshold voltage for turning ON the two-terminals-thyristor 6, then, the thyristor 6 turns ON at the phase $\theta_3$ and the charging current flows into the non-linear dielectric element 4.

The positive voltage $V_{13}$ across the non-linear dielectric element 4 until the phase $\theta_3$ is as follows. At the phase $\theta_1$, the voltage $V_{11\text{-}1}$ across the fluorescent lamp 1 is divided by the non-linear dielectric element 4 and the resistor 7, and the divided voltage is applied across the non-linear dielectric element 4. It should be noted that the voltage $V_{11\text{-}1}$ across the fluorescent lamp 1 and its divided voltage $V_{13\text{-}1}$ are rather low since the phase $\theta_1$ when the thyristor 301 is turned ON is small. It should be noted further that the non-linear dielectric element 4 does not have the non-linear nature when the voltage across the same is low, in particular, when that voltage is lower than the saturation voltage $E_s$, since the non-linear nature, or the hysteristis nature of the element comes from the inner polarization of the dielectric body. Accordingly, even if the dielectric element 4 is charged at the phase $\theta_3$ by the charge current through the thyristor 6, the spike voltage $V_{21\text{-}1}$ across the dielectric element 4 is rather low. Thus, it should be noted that the spike voltage depends upon the preceding voltage in the positive direction.

At the second half cycle of the power supply voltage, the capacitor 304*b* is charged by the current through the diode 305, the resistors 303*c* and 303*d*, and the voltage across that capacitor 304*b* is increased. Therefore, the increase of the voltage across the resistor 303*d* is delayed according to the charged voltage across the capacitor 304*b*, and then, the firing phase $\theta_4$ at the second half cycle is delayed as compared with the firing phase $\theta_1$ at the first half cycle. Accordingly, the voltage $V_{11\text{-}2}$ across the fluorescent lamp 1 at the phase $\theta_4$ is higher than that at the phase $\theta_1$, and then, the voltage $V_{13\text{-}2}$ across the non-linear dielectric element 4 at the second half cycle is higher than the voltage $V_{13\text{-}1}$ at the first half cycle, and the dielectric element 4 shows a trace of a non-linear nature. Thus, the spike voltage $V_{21\text{-}2}$ at the second half cycle is higher than the first spike voltage $V_{21\text{-}1}$.

By repeating the above process, the spike voltage $V_{21}$ increases for every half cycle of the power supply voltage, and when the filaments 101*a* and 101*b* are preheated sufficiently and the spike voltage $V_{21}$ exceeds the firing voltage of the fluorescent lamp 1, then, the fluorescent lamp 1 is fired. When the fluorescent lamp 1 is fired, the voltage across the fluorescent lamp 1 is decreased due to the presence of the balast 2, the thyristor 301 does not turn ON. Thus, the lamp 1 brights stably.

The resistor 303*e* in FIG. 4 is provided for discharging the capacitor 304*b*. That resistor 303*e* discharges the capacitor 304*b* when the power switch is OFF to initiate the timer circuit for the preparation for the next operation when the power switch is turned ON again. The capacitor 304*b* together with the resistor 303*c* operate as a smoother circuit to absorb the noise component at the gate circuit of the thyristor 301.

As described above, according to the present invention, the spike voltage $V_{21}$ across the fluorescent lamp is low just when the power switch is turned ON, and that spike voltage increases gradually for every half cycle of the power supply voltage. Therefore, the spike voltage before the filaments 101*a* and 101*b* are pre-heated enough is low, and the filaments do not sputter. Thus, the life time of a fluorescent lamp is improved.

The numerical embodiment according to the circuit of FIG. 4 is described. We tested a 40 watt fluorescent lamp with the circuit of FIG. 4 which has the components as shown in the table 1. We observed that the spike voltage $V_{21}$ just after the power switch is turned ON is 600 volts, and the fluorescent lamp is fired in 1.0 second when the spike voltage $V_{21}$ is 900 volts. The firing operation of that fluorescent lamp was accomplished 10,000 times. After 10,000 firing test, we measured the sputtered radiation element on the filaments 101*a* and 101*b*, and found that the amount of the sputtered element in 10,000 firing tests was approximately only one-third ($\frac{1}{3}$) of that of the prior circuit of FIG. 1.

TABLE 1

| Components | Specification |
|---|---|
| Thyristor 301 | SCR 2A, 1200 volts |
| Diode 305 | 0.5 A, 1200 volts |
| Trigger element 302 | Diac, switching voltage 31 volts |
| Thyristor 6 | PNPN switch, $V_{v0}$ = 250 volts |
| Non-linear dielectric element 4 | Barium-titanate group dielectric body, Electrode area 200 $mm^2$ Thickness 0.4 mm Saturation voltage 45 volts |
| Resitor 7 | 22 Kilo-ohms |
| Resistor 303c | 330 Kilo-ohms |
| Resistor 303d | 220 Kilo-ohms |
| Resistor 303e | 10 M ohms |
| Capacitor 304b | 0.1 μF |
| Capacitor 304c | 0.0068 μF |
| Capacitor 5 | 0.006 μF |
| Balast 2 | 750 m Henry (measured by 1 $KH_z$, 1V) |

Figure 6:
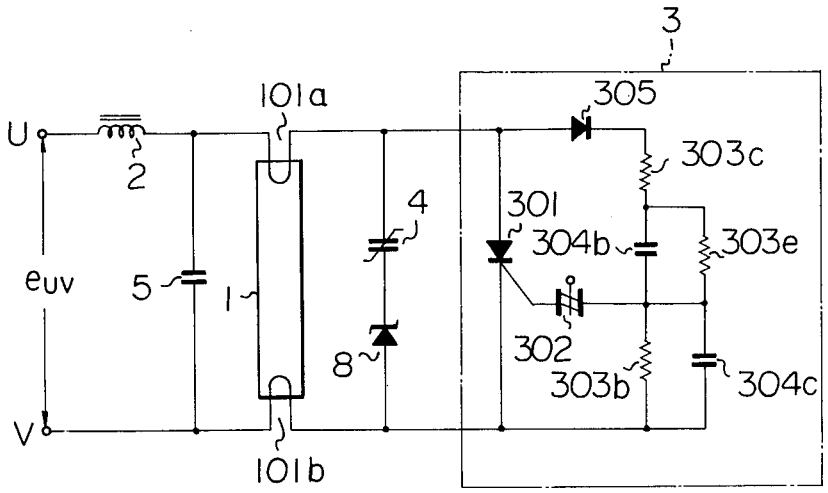
FIG. 6 is another circuit diagram of the discharge lamp lighting device according to the present invention.

FIG. 6 is the circuit diagram of another embodiment of the discharge lamp lighting device according to the present invention. The feature of FIG. 6 is the presence of the zener diode 8 coupled in series with the non-linear dielectric element 4, instead of the thyristor 6 and the resistor 7 in FIG. 4. In the embodiment of FIG. 6, the positive voltage across the non-linear dielectric body 4 just after the power switch is turned ON is;

$$V_{13}=(V_{11}l-V_z)$$

where $V_z$ is the zener voltage of the zener diode 8. The semiconductor switch 3 in FIG. 6 is similar to that in FIG. 4, and the firing phase is delayed for every half cycle, and the positive voltage $V_{11}$ across the lamp when being fired increases for every half cycle. Accordingly, the voltage across the non-linear dielectric element 4, and the spike voltage increase gradually. Therefore, the circuit of FIG. 6 has the effect to prevent the sputtering of the radiation material on the filaments.

Figure 7:
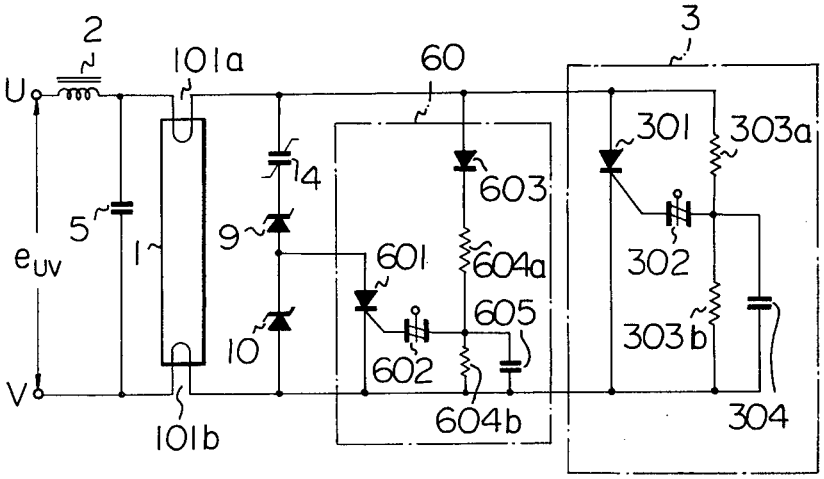
FIG. 7 is a still another circuit diagram of the discharge lamp lighting device according to the present invention.

FIG. 7 is still another embodiment of the discharge lamp lighting device according to the present invention. The feature of the embodiment of FIG. 7 is the presence of a plurality of zener diodes 9 and 10 coupled in series with the non-linear dielectric element 4 with the polarity as shown in FIG. 7. The zener voltage of the series connected zener diodes 9 and 10 is steered by the second semiconductor switch 60, which has a three-terminals-thyristor 601, the trigger element 602 connected to the gate circuit of said thyristor 601, the diode 603, the resistors 604*a* and 504*b*, and the capacitor 605. The series circuit of the resistor 604*a* and the capacitor 605 composes a timer circuit. The resistor 604 is provided for discharging the capacitor 605. The semiconductor switch 3 is the same as the semiconductor switch 3 in FIG. 1.

Figure 2:
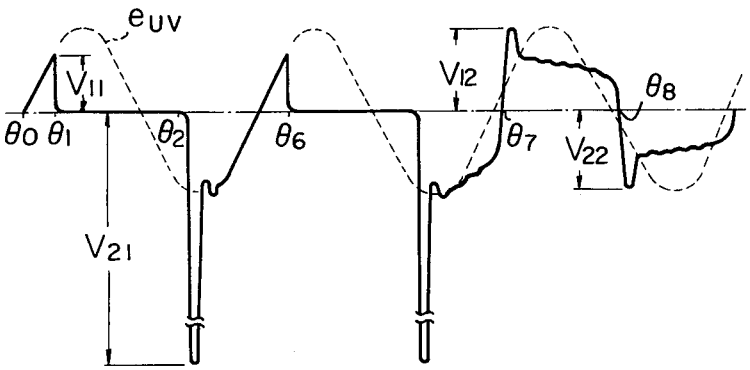
FIG. 2 shows operational waveform of the device of FIG. 1.
Figure 3:
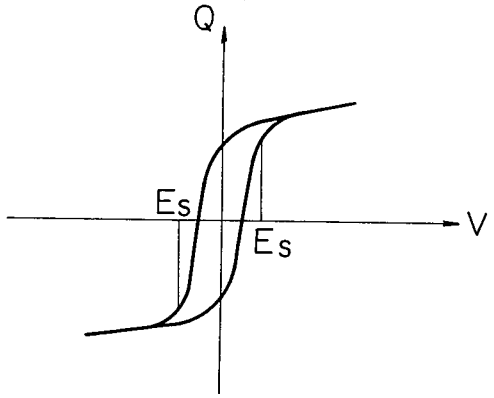
FIG. 3 shows a hysterisis curve between applied voltage and charge in a non-linear dielectric element.

In FIG. 7, when the power switch (not shown) is turned ON, the voltage across the capacitor 605 is almost zero, and the thyristor 601 is in OFF status. Therefore, the voltage across the non-linear dielectric capacitor 4 is the difference between the voltage across the fluorescent lamp 1 and the zener voltage ($V_{z9}+V_{z10}$) which is the sum of the zener voltage $V_{z9}$ of the first zener diode 9 and the zener voltage $V_{z10}$ of the second zener diode 10. Supposing that the total zener voltage ($V_{z9}+V_{z10}$) is approximately equal to the power supply voltage $V_{11}$ (see FIG. 2), then, the voltage $V_{13}$ across the non-linear dielectric element 4 is almost zero, then, the spike voltage $V_{21}$ just when the power switch is turned ON is low.

The voltage across the capacitor 605 increases for every half cycle, and when that voltage across the capacitor 605 exceeds the threshold voltage of the trigger element 602, the thyristor 601 turns ON. Then, the zener diode 10 is short-circuited by the thyristor 601, and the voltage across the non-linear dielectric element 4 increases. Therefore, the spike voltage becomes high enough to fire the fluorescent lamp 1. Accordingly, in the embodiment of FIG. 7, the spike voltage just when the power switch is turned ON is low, and that spike voltage increases gradually, then, the radiation material on the filaments is not sputtered.

Figure 8:
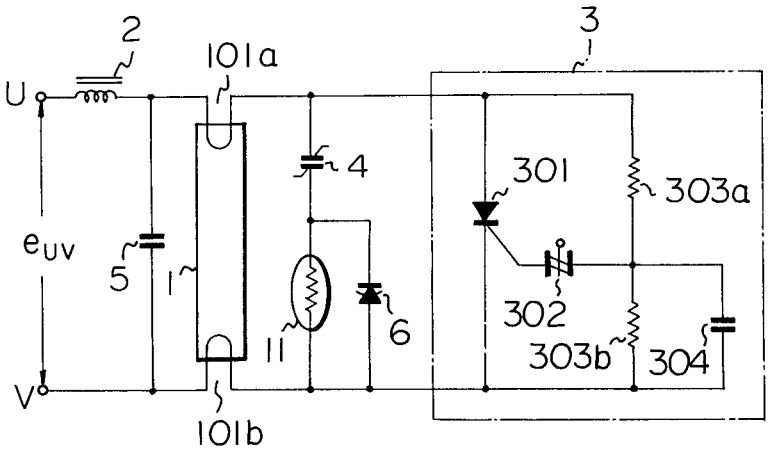
FIG. 8 is a still another circuit diagram of the discharge lamp lighting device according to the present invention.

FIG. 8 is the still another embodiment of the fluorescent lamp lighting device according to the present invention. In the figure, the reference numeral 11 is a thermistor with the negative temperature coefficient (NTC), andd 6 is the two-terminals-thyristor. Other components in FIG. 8 are the same as those in FIG. 1.

In FIG. 8, when the power switch (not shown) is turned ON, the temperature of the NTC therminator 11 is low, and the resistance of the same is high. Therefore, the voltage across the non-linear dielectric element 4, and the spike voltage are low. The NTC thermistor 11 is heated by the current which flows in each cycle. Thus, the resistance of the NTC thermistor 11 decreases as the temperature of the same increases. Therefore, the voltage across the non-linear dielectric element 4 and the spike voltage increase gradually to fire the fluorescent lamp 1.

Accordingly, the circuit of FIG. 8 has the same effect as that of the previous embodiments of FIGS. 4, 6 and 7.

As described above in detail, the present discharge lamp lighting device has a timer circuit which increases the spike voltage gradually. The increase of the gradual spike voltage is accomplished by shifting the firing phase of the thyristor 301, and/or by switching a resistor coupled in series with the non-linear dielectric element. Thus, the radiation material on the filaments is not sputtered, and the life time of a lamp is improved.

From the foregoing, it will now be apparent that a new and improved discharge lamp lighting device has been found. It should be understood of course that the embodiments disclosed are merely illustrative and are not intended to limit the scope of the invention. Reference should be made to the appended claims, therefore, rather than the specification as indicating the scope of the invention.

What is claimed is:

1. A discharge lamp lighting device comprising;
a discharge lamp with a pair of filaments coupled with a power supply through an inductive balast,
a non-linear dielectric element coupled between said filaments,
a semiconductor switch coupled parallel with said non-linear dielectric element, said semiconductor switch closing at some phase of a power supply voltage, and
delay means for gradually increasing a positive voltage across said non-linear dielectric element.

2. A discharge lamp lighting device according to claim 1, wherein said means for gradually increasing a positive voltage across said non-linear dielectric element has a timer circuit in said semiconductor switch, said timer circuit shifting for every half cycle of a power supply voltage a firing phase of the semiconductor switch.

3. A discharge lamp lighting device according to claim 2, said semiconductor switch has a thyristor, a gate of which is supplied a power supply voltage through said timer circuit.

4. A discharge lamp lighting device according to claim 3, wherein said timer circuit has a series circuit with a resistor and a capacitor, and a coupling point of the resistor and the capacitor is coupled with the gate of the thyristor.

5. A discharge lamp lighting device according to claim 1, wherein said delay means has a plurality of series connected zener diodes coupled in series with said non-linear dielectric element, a zener voltage of said zener diode decreases gradually so that a voltage across said non-linear dielectric element increases gradually.

6. A discharge lamp lighting device according to claim 1, wherein said delay means has a parallel circuit with a thermistor with negative temperature coefficient and a thyristor, said parallel circuit is coupled in series with said non-linear dielectric element, so that a voltage across said non-linear dielectric element increases gradually as temperature of said thermistor increases and resistance of the same decreases.

* * * * *